United States Patent [19]

Goldhammer

[11] Patent Number: 4,650,128

[45] Date of Patent: Mar. 17, 1987

[54] APPARATUS FOR COMMINUTING MATERIALS SUCH AS DOCUMENTS, ETC.

[75] Inventor: Albert Goldhammer, Ueberlingen, Fed. Rep. of Germany

[73] Assignee: Feinwerktechnik Schleicher & Co., Fed. Rep. of Germany

[21] Appl. No.: 594,304

[22] Filed: Mar. 28, 1984

[30] Foreign Application Priority Data

Apr. 12, 1983 [DE] Fed. Rep. of Germany ..... 3312991

[51] Int. Cl.[4] ..... B02C 25/00

[52] U.S. Cl. ..... 241/36; 241/100

[58] Field of Search ..... 241/34, 100, 36, 63, 241/64

[56] References Cited

U.S. PATENT DOCUMENTS

| | | | |
|---|---|---|---|
| 405,019 | 6/1889 | Drude | 241/100 X |
| 2,398,932 | 4/1946 | Grant | 241/100 |
| 2,899,140 | 8/1959 | Hellyer | 241/100 X |

FOREIGN PATENT DOCUMENTS

| | | | |
|---|---|---|---|
| 1061492 | 7/1959 | Fed. Rep. of Germany | 241/100 |
| 2214799 | 9/1973 | Fed. Rep. of Germany . | |
| 2942241 | 4/1981 | Fed. Rep. of Germany . | |
| 3005663 | 8/1981 | Fed. Rep. of Germany . | |
| 3112667 | 10/1982 | Fed. Rep. of Germany . | |
| 113176 | 10/1978 | Japan | 241/100 |
| 328053 | 2/1958 | Switzerland | 241/100 |

*Primary Examiner*—Mark Rosenbaum

*Attorney, Agent, or Firm*—Steele, Gould & Fried

[57] ABSTRACT

A document shredder standing on a subframe has an outlet opening from which comminuted material falls into a basket. A swingably mounted flap loaded resiliently by a knee lever mechanism serves simultaneously as a full condition sensor against overfilling of the basket and as a closure for the outlet opening and in both these positions switches the document shredder off. It is brought from the closure position to the working position automatically on sliding in the basket, and on its removal into the closed position again.

16 Claims, 2 Drawing Figures

APPARATUS FOR COMMINUTING MATERIALS SUCH AS DOCUMENTS, ETC.

FIELD OF THE INVENTION

This invention relates to an apparatus for comminuting materials, such as documents etc., commonly called document shredders.

BACKGROUND TO THE INVENTION

When using such devices, the comminuted material usually falls into a container which can be taken out and emptied. With past designs it is, however, possible that, even with the comminution mechanism stationary, material still falls down, if the container is pulled or swung out, which then falls onto the floor or into the space which receives the container. Additionally generally it cannot be determined when the container has been filled, so that often it is taken out too late, so that it is overfilled and on taking out the container comminuted material falls on the floor.

SUMMARY OF THE INVENTION

It is a principal object of the invention to produce apparatus for comminuting materials such as documents etc. in which the container of the waste can be removed without the danger of comminuted material falling out.

It is a further object of the invention to provide apparatus for this type whish is safe in use and out of use.

In accordance with the invention, there is provided, in apparatus including a comminution mechanism, an inlet and an outlet opening for feed of material to the mechanism and removal of comminuted material, wherein the outlet opening is to be arranged above a container for the comminuted material, the improvement consisting of a movable interrupter element capable of projecting across the region of the outlet opening into the flow of the comminuted material, and, in dependence on the container or its filling, of interrupting the flow of the comminuted material.

The interrupter element can advantageously be actuatable by the container to open or close the outlet opening. If then the container is moved out of its receiving position, for example pulled out from a recess which receives it, then it actuates the interrupter element which closes itself preferably under spring-loading. Although it would also be possible to construct the interrupter element as a slide which would run for a certain distance with the container, it is however advantageous if the interrupter is a swingable flap which is pivoted swingably about an essentially horizontally arranged axis adjacent the outlet opening. Such a swingable flap works counter to the falling direction of the comminuted material and closes the outlet opening off well without leading to the danger of its becoming clogged by this material. The interrupter element can have an actuation element preferably constructed as an addition at an angle to the flap which is arranged in the path of movement of the insertable and removable container. The interrupter element can accordingly be constructed as a flap shaped with an angle, mounted in the region of its bend, one arm of which is operated by the upper container rim, which is particularly simple and certain in use. Thereby yet a further important advantage is achieved, which consists in that with the container taken out, the outlet opening is also closed against inadvertent access from below.

According to a further feature of the invention the interrupter element can be constructed as an overfilling sensor for the container. For this preferably the interrupter element in its normal opening position can project into the container in such a way that the comminuted material prior to overfilling of the container presses the interrupter element into a yet further opened position and a switching member switches off the comminution mechanism in this position.

Particularly preferred accordingly is the interrupter element with a triple function namely on the one hand to turn off the apparatus on overfilling of the container and/or to release an optical and/or acoustic warning, and on the other hand it closes on the subsequent removal of the container the outlet opening and secures this against accidental access. Advantageously in this connection a switching member coupled with the interrupter element can control the comminution mechanism and switch this on preferably only in its normal open position. In this case accordingly it is ensured even with the container removed that the comminution mechanism cannot be left on in error.

The interrupter element can preferably be loaded by spring-loading increasing in the direction towards its closure position. This can be applied by means of a knee lever mechanism, so that the spring-loading in the opening position is relatively small, but on closure of the outlet opening the spring-loading is powerful.

The actuation of the interrupter element using its ability as an overfilling sensor can preferably occur in that the flap constituting the interrupter element can define in its normal opening position a space in the container free from comminuted material into which it can be pressed back with a full container by the subsequently flowing comminuted material. In this fashion even with relatively light and elastic material the flap can be actuated with sufficient force because a dam builds up from the subsequently flowing material which moves the flap against the spring force, which is small in this direction in any case, to actuate the switching member.

BRIEF DESCRIPTION OF THE DRAWINGS

Features of preferred embodients of the invention are evident from the following description and the attached drawings, wherein these features and the features of the sub-claims in each case can be realised in an embodiment of the invention by themselves or several of them in the form of sub-combinations. One embodiment of the invention is illustrated in the drawing, wherein:

DETAILED DESCRIPTION OF THE PREFERRED EMBODIMENTS

Figure 1:
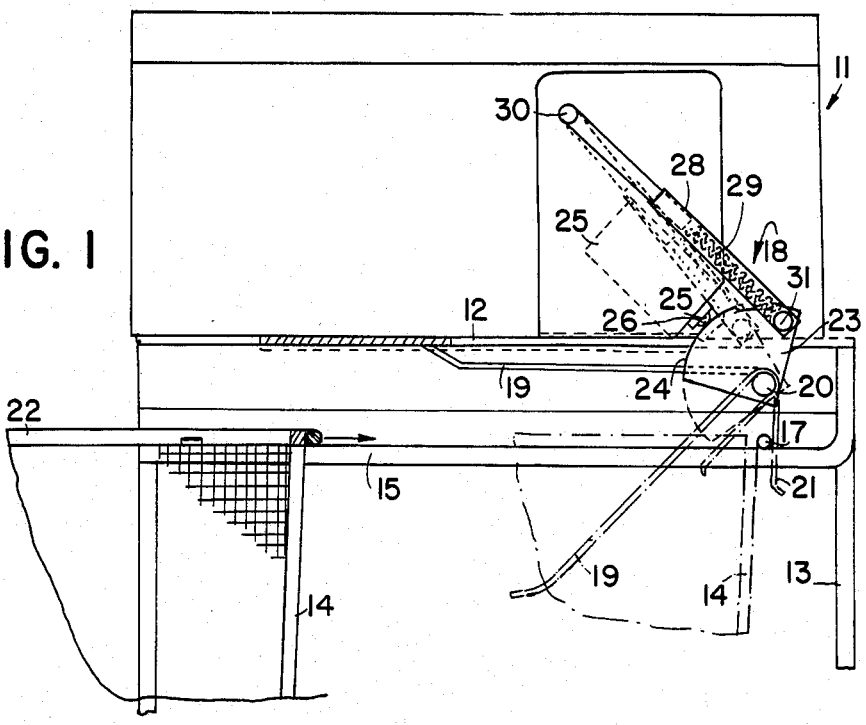
FIGS. 1 and 2 are in each case a vertical partial section through an apparatus for comminuting sheet materials, particularly its subframe in two different working positions.

Illustrated in the drawings is a device for comminuting documents, written material or other sheet materials or sheet material layers, which is generally denoted as a document shredder. The apparatus 11, which contains, in fashion known per se, two comminution rolls with appropriate drive and control, is not illustrated in detail. It has an outlet shaft which issues into an outlet opening 12. It sits on a subframe 13 which contains a guide for a container 14 which can be slid in from the side (from the left in the drawings) for example a basket for the receipt of the comminuted material falling from the outlet opening 12. The subframe 13 is here illustrated as an upright framework with open sides. However a corresponding lower chest can be provided on which the comminution apparatus 11 stands or the subframe can contain only the guides for the basket and otherwise be built into a piece of furniture. The guides 15 consist of horizontal lateral rails on which a projecting rim 17 of the basket frame runs. They can have a step 16 at their one end in order to determine the correct position of the container 14 below the outlet opening 12.

Figure 2:
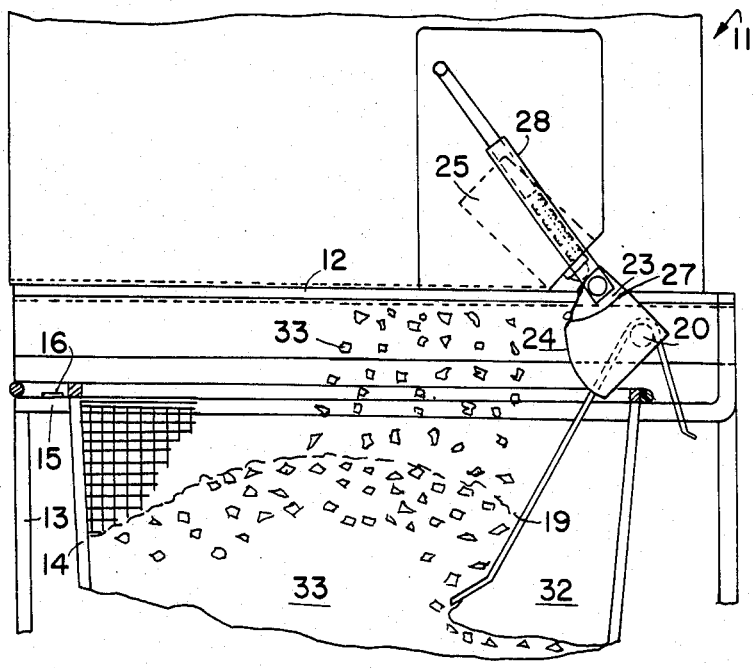

Provided on the subframe is an interrupter device 18 which can also be a part of the comminution apparatus 11 itself and which is illustrated in the drawing for better illustration enlarged in comparison to the other apparatus parts. It has an interrupter element 19 which has the shape of a flap mounted swingably about a horizontal axis 20 which is swingable between the closure position illustrated in FIG. 1 in continous lines, in which it closes the outlet opening 12, an operative position which is illustrated in FIG. 1 in dash-dot lines and an overfilling position which is shown in FIG. 2. In the closure position the flap, which is a relatively large surface area and bent off at its end, is located horizontally below the outlet opening while in the operative position it projects obliquely into the container and in the overfilling position is swung yet further into the container.

The interrupter device 18 has a portion going off at an acute angle from the flap surface, which constitutes an actuation element 21. It projects into the path of the upper frame portion 22 of the container and can be actuated by the part of the rim 17 lying forwardly in the pushing-in direction. It thus lies in the path of the insertable and removable container 14. Connected with the interrupter element and the actuation element connected thereto is a switch segment or cam 23, the switch surface 24 of which cooperates with an electrical limit switch member 25. An actuation button 26 of the switch member runs on the switch surface 24. The switch member 25 is connected with the control of the apparatus 11 and enables the comminution apparatus to be put into action only if the actuation button runs in the depression 27 provided in the switching surface 24.

Pivoted to the switching segment 23 is a spring pusher 28 which consists of two tubes engaging telescopically one in another which are pressed apart from one another by a compression spring 29 lying in one tube. The arrangement of the pivot point 30 of the spring pusher on a fixed part of the machine, its pivot point 31 on the switching segment and the axis 20 is such that it gives a knee lever action. Thereby in the closure position illustrated in FIG. 1 the interrupter element is applied with relatively large force to the boundary of the outlet opening 12, because the pivot points 30, 31 and the axis 20 form a triangle with a relatively large effective lever arm. In the operative position (dash-dot lines in FIG. 1) in contrast the leverage diminishes substantially so that substantially no spring force effective in the closure direction acts on the interrupter element. The interrupter can accordingly be brought with relatively small force over the dead point of the knee lever mechanism consisting of spring pusher 28 and switching segment 23 in order then, with spring force support, to move into the overfilling position (FIG. 2).

The apparatus works as follows: With the container removed the interrupter device takes up the closed position illustrated in continuous lines in FIG. 1 i.e. the knee lever mechanism 23, 28 presses the interrupter element 19 against the underside of the outlet opening and closes this off. Thereby it is prevented that material which has been divided in the comminution apparatus into small particles still falls down, even when the apparatus is out of use, since the switching segment has via the switching member 25 switched the apparatus off.

If as illustrated in FIG. 1 a container 14 is pushed on the guide 15 into the subframe 13, then in the last part of this pushing-in process the actuation element 21 is pressed towards the right and swings accordingly as a result of the mechanical coupling of the interrupter element 19 into the working position illustrated in dash-dot lines. Thereby the actuation button 26 of the switching member 25 comes into the depression 27 and the comminution apparatus 11 is ready for use and can be put into action as necessary. The comminuted material falls through the now open outlet opening 12 into the container. Thereby part of the comminuted material falls onto the interrupter element 19 but does not deflect the interrupter to cause operation of switch 25 since the comminuted material is comprised of light and loose particles which exert during their fall no substantial forces.

When the container fills and its filling level reaches the interrupter element, then as a result of the fact that the outlet opening feeds only to one side of the interrupter element 19, comminuted material collects in front of and on the interrupter element while the space 32 behind the interrupter element remains substantially empty. The interrupter element, which is constructed as a flap, has because of this a relatively large area which extends over a substantial portion of the width of the container, in order to create this free space. When finally the pile of comminuted material 33 has become large enough, then by means of the weight of material and perhaps also by action of the comminution apparatus on the dammed material, the interrupter element 19 is moved counter-clockwise i.e. into the free space 32. As soon as the dead point of the knee lever mechanism has been passed, the knee lever mechanism helps the interrupter along so that the switching member 25 is operated with certainty and the comminution apparatus is out of action and indeed protected. Also in place of this or additionally an acoustic or optical warning device can be operated which shows that the container is full, or a delay circuit can be put in, in order to comminute a little more, for example the material already contained in the apparatus, before switching off takes place.

If now the container 14 is pulled out of the guide 15, then the interrupter element swings clockwise as shown in the drawings back upwardly, since the axis 20 is arranged in the region of the rear rim of the container away from the container removal side. The interrupter element flaps upwardly again under the force of the knee lever mechanism 23, 28 and closes the outlet opening 12. Since the switching off of operation is overcome only by a manual switch, it does not matter that during container removal the actuation position is passed through again before in the closed position the switch secures the apparatus 11 against erroneously being put into action. However additionally a limit switch could be provided which for example was actuated on the beginning of the removal of the container, for example on the opening of a door of the lower portion, or the switching member 25 could be so constructed that it allows the putting into action of the comminution apparatus only if the operative position has been preceded by the closed position.

The apparatus according to the invention thus has a multiple function: It switches the comminution apparatus off with the container removed and thus prevents on the one hand the build up of comminuted material in the lower frame, the chest or in the open and takes care that with the container removed the comminution apparatus remains stationary in all cases. Furthermore it effects a mechanical closure of the outlet opening and thereby prevents falling down of loose comminuted material on the apparatus below. Furthermore automatic switching off when the correct full condition of the container is realised, which has the benefit that the container can not overflow and accordingly the subframe or the chest outside the container cannot be filled or the comminuted stuff fall into the open. Furthermore, the device avoids on the other hand damage in the comminution apparatus as a result of a substantial back build-up of comminuted material from below. The apparatus thus works wholly automatically and requires no monitoring by the operating personnel. In this connection, it is particularly advantageous that the interrupter element on removal and reinsertion of the container is automatically swung into and out of its operative position in the interior of the container. Additionally it is ensured that the apparatus can only be operated with its container since otherwise the correspondingly formed and arranged actuation element 21 is not actuated. The apparatus can accordingly not be used with any size box or the like as container, which is also undesirable since a container of the wrong size could in certain circumstances not secure the outlet opening against access.

Although in the drawing a preferred embodiment is illustrated, numerous variations from this are possible. It could for example be possible so to construct the interrupter element that the functions of the closure flap and the full condition sensor were carried out by two different components if space considerations require this. The actuation element 21 can be arranged as a separate element and the knee lever mechanism can be arranged separately from a switch actuation element. It would also be possible to allow the interrupter element to project into the container substantially vertically where it would be operated by falling down balls of rubbish, and by back build-up of a pile of comminuted material from the comminution apparatus.

I claim:

1. An apparatus for comminuting sheet material, comprising:

a comminution mechanism having an inlet and an outlet for feeding material to comminution mechanism and removal of comminuted material therefrom;

a container for receiving the comminuted material, the container being positionable below the outlet;

a movable interrupter element projectable across the outlet opening, the interrupter element being movably positionable in:

(a) a closing position in which the interrupter element positively closes the outlet opening, the interrupter element blocking the comminuted material from passing the outlet opening, (b) an operative position in which the outlet opening is open and free for flow of the comminuted material, and (c) an excess sensing position, in which the outlet opening is also open and free for flow of the comminuted material;

the movable interrupter element having an actuation element cooperating with the container for moving the interrupter element into the operative position when the container is moved into place below the outlet and for moving the interrupter element into the closing position when the container is removed from below the outlet; and, switching means for controlling the comminution mechanism and cooperating with the interrupter element, the switching means being operative to detect overfilling of the container in the excess sensing position of the interrupter element and to detect the closing position of the interrupter element, whereby the comminution mechanism is switched off in the closing position.

2. The apparatus of claim 1, wherein the interrupter element is a swingable flap which is pivoted about an essentially horizontal axis arranged near the outlet.

3. The apparatus of claim 2, wherein the flap is spring-loaded.

4. The apparatus of claim 2, wherein the interrupter element has an actuation element arranged at an angle to the flap, the actuation element being in a path of insertion and removal of the container, the actuation element being contacted by the container to move the interrupter element from the closing position to the operative position upon insertion of the container.

5. The apparatus of claim 4, wherein the actuation element is constructed as an extending piece of the flap.

6. The apparatus of claim 1, wherein the interrupter element is spring-loaded in a direction towards a closed position.

7. The apparatus of claim 6, wherein the interrupter element includes a knee lever mechanism.

8. The apparatus of claim 7, wherein the knee lever mechanism has a telescoping spring pusher pivoted to a housing of the apparatus and a pivotal switch segment attached to the interrupter element, the spring pusher and the switch segment being pivotally connected.

9. The apparatus of claim 1, wherein the switching means controls power to the comminution mechanism, the switching means turning on power only when the interrupter element is in an unblocking operative position.

10. The apparatus of claim 1, wherein the switching means also switches off the comminution mechanism in said excess sensing position.

11. The apparatus of claim 10, wherein the switching means also switches on an indicator when the interrupter element is pressed into the further opened position.

12. The apparatus of claim 1, wherein the switching means switches on an indicator when the interrupter element is pressed into the further opened position.

13. The apparatus of claim 12, wherein the indicator is optical.

14. The apparatus of claim 12, wherein the indicator is acoustic.

15. The apparatus of claim 1, wherein the interrupter element projects into the container in the operative and excess sensing position whereby accumulation of the comminuted material presses the interrupter element from its operative position into its excess sensing position.

16. The apparatus of claim 1, wherein the movable interrupter element defines a space free from comminuted material into which space the interrupter element is adapted to be pushed by accumulated comminuted material while the interrupter element is moved from its operative to its excess sensing position.

* * * * *